US006181022B1

(12) United States Patent
Johansson et al.

(10) Patent No.: US 6,181,022 B1
(45) Date of Patent: Jan. 30, 2001

(54) KEYBOARD IN STATIONARY VEHICLE CONTROL UNITS

(75) Inventors: Alf Johansson, Lekeryd; Gunnar Lejonberg, Huskvarna, both of (SE)

(73) Assignee: Combitech Traffic Systems AB, Jonkoping (SE)

( * ) Notice: Under 35 U.S.C. 154(b), the term of this patent shall be extended for 0 days.

(21) Appl. No.: 09/284,500

(22) PCT Filed: Oct. 9, 1997

(86) PCT No.: PCT/SE97/01685

§ 371 Date: May 28, 1999

§ 102(e) Date: May 28, 1999

(87) PCT Pub. No.: WO98/16392

PCT Pub. Date: Apr. 23, 1998

(30) Foreign Application Priority Data

Oct. 14, 1996 (SE) ..... 9603787

(51) Int. Cl.[7] ..... H01H 13/70

(52) U.S. Cl. ..... 307/10.1; 340/407.2; 345/168; 345/173; 379/434

(58) Field of Search ..... 307/10.1, 132 R, 307/116; 379/434, 428; 345/173, 168; 340/407.2; 361/680

(56) References Cited

U.S. PATENT DOCUMENTS

| | | | | |
|---|---|---|---|---|
| 4,169,218 | * | 9/1979 | Tyler | 379/434 |
| 4,818,048 | * | 4/1989 | Moss | 345/173 |
| 4,852,146 | * | 7/1989 | Hathcock et al. | 455/564 |
| 5,100,178 | * | 3/1992 | MacKelvie | 281/44 |
| 5,113,974 | * | 5/1992 | Vayda | 186/36 |
| 5,128,672 | | 7/1992 | Kaehler . | |

FOREIGN PATENT DOCUMENTS

| | | |
|---|---|---|
| 2 028 459 | 4/1991 | (CA) . |
| 0254015 | 1/1988 | (EP) . |
| 2642201 | 7/1990 | (FR) . |
| 2299302 | 10/1996 | (GB) . |

* cited by examiner

*Primary Examiner*—Albert W. Paladini
(74) *Attorney, Agent, or Firm*—Pollock, Vande Sande & Amernick

(57) ABSTRACT

A keyboard means in stationary control units (23) in a vehicle. The keys (24) thereof are arranged at an outer edge portion of the unit (23), which has the shape of a thin plate (23), which may be embraced in a pinching movement, preferably a pinching movement between the thumb and some finger. The keys may thus be pressed down from one side of the edge portion while supporting it from the opposite side by another finger. This results in very limited free forces against the unit during operation.

4 Claims, 2 Drawing Sheets

KEYBOARD IN STATIONARY VEHICLE CONTROL UNITS

TECHNICAL FIELD

The present invention relates to a keyboard means in stationary vehicle control units, and particularly such which comprise a transponder for radio communication by means of microwaves.

STATE OF THE ART

A vehicle may comprise control units with keys which are to be pressed by the driver when he wishes certain commands to be executed. Since the driver at the same time must control the vehicle, the keys have to be located within reach from the driver's seat and should be easy to operate. This requirement may be well satisfied in keyboards with a fixed, stable location in the vehicle close to the driver's seat.

However, control units may occur which do not have this design. As an example may be mentioned units for extra equipment, which cannot be provided with a fixed, stably placed keyboard and, in that case, especially such extra equipment which has to be located in a place which is not quite favourable for the operation of the driver. An example of such extra equipment which has become increasingly more frequent is a transponder for communication by means of microwaves with roadside stations, at which payment of a toll fee during passage of the vehicle is to be carried out through radio communication. In this context, communication by means of radio waves has the advantage that a selective communication with individual vehicles passing may be maintained from the toll station, because of the slight spatial propagation of the waves. Such communication is therefore suited for registration of traffic fees in case of a free traffic flow through toll stations, see e.g. EP A2 0 425 961 (Pierluigi). In order that the communication equipment of the vehicle should be possible to reach by means of the microwaves, it is largely required that the receiving part thereof is positioned such that it is visible from the transmitter. As receiving and also retransmitting unit, a transponder is mostly used in the vehicle equipment, this transponder being capable of receiving an information-carrying signal from the roadside transmitter and retransmitting it in such modulated form that response information may be conveyed.

A location of the transponder, which is advantageous from many points of view, has proved to be inside the windshield of the vehicle. When approaching the roadside transmitter, it will then be facing the transmitter and is capable of receiving and returning the radio signal, which penetrates the windshield, while the vehicle unit is in a protected position inside the vehicle. In addition to providing protection against the effect of the weather and against theft, the location inside the vehicle implies also that the unit becomes accessible to the vehicle driver, which is necessary if some operating means have to be acted on or display means need to be observed.

Since the main function of the transponder is to provide for communication with the roadside equipment, the location of the transponder must primarily be adapted to this function. As mentioned, one advantageous location is inside the windshield of the vehicle and at a certain height, in private cars preferably at the upper edge of the windshield. In this way, the location with respect to the possibilities of the driver to operate the transponder, by means of keys applied directly thereon, may become less favourable. The size must also be limited in order not to block the driver's view too much. Arranging, with this location, a regular keyboard is therefore not possible. If it is not desired to refrain from the possibility of keyboard operation, there is therefore only the possibility of dividing the communication unit of the vehicle into a communication part, the actual transponder, and a control part, and connecting these two parts by an internal communication link. However, this would entail a considerable additional cost in relation to arranging the control means directly on the transponder and, in addition, it will be necessary to arrange wiring between the two parts.

DESCRIPTION OF THE INVENTION

The object of the invention is to achieve a vehicle unit, which may be located in such a way in the vehicle that it is useful for its functions. As already mentioned, the main functions are communication with the roadside equipment via radio waves and the possibility of manual operation of the communication unit by means of keys. The first-mentioned function is fulfilled in the best way if the transponder unit is given the described elevated location on the windshield of the vehicle whereas the second function requires a special design of the control means in order that they may be operated by the driver while travelling in spite of the mentioned location, which is required for reasons of communication.

According to the invention, a comfortable and safe control is made possible by a keyboard arrangement, wherein the operation takes place by a pinching movement with the thumb and index finger of the hand instead of the depression of a key supported by a fixed base which is required in conventional keyboards.

BRIEF DESCRIPTION OF THE DRAWINGS

An embodiment of the invention will be described in the following with reference to the accompanying drawings, wherein.

PREFERRED EMBODIMENT

Figure 1:
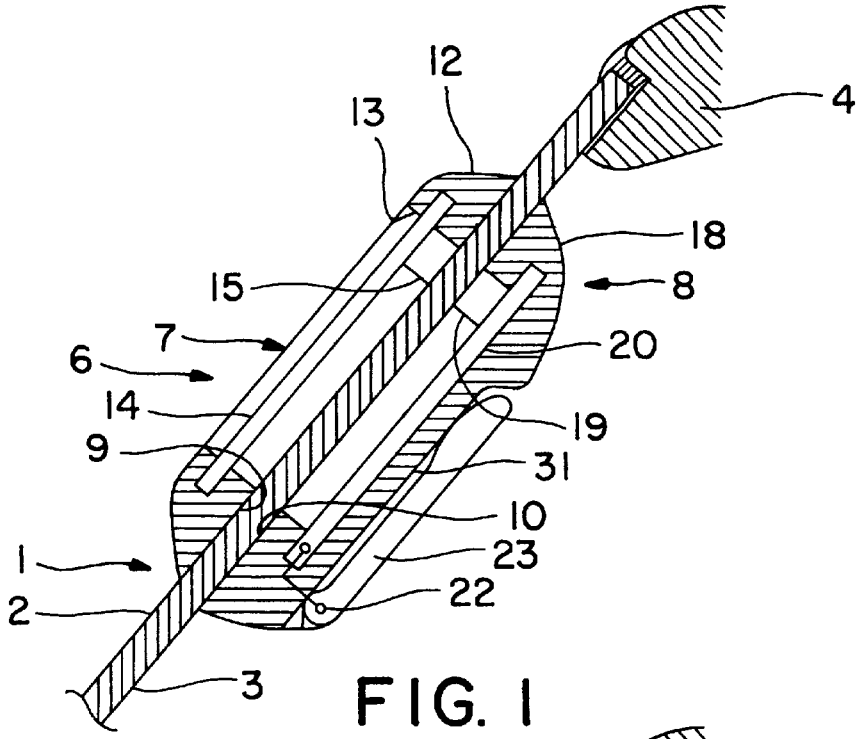
FIG. 1 is a cross section of the windshield of a vehicle with the vehicle unit placed thereon and shown partly in cross section.

In FIG. 1, numeral 1 designates the upper part of the windshield in a vehicle, the outer side being designated 2 and the inner side 3. The windshield is attached to the vehicle structure, for example by gluing, which is indicated by a portion of a vehicle roof 4.

The vehicle unit, designated 6, comprises an exterior part 7, attached to the outer side 2 of the windshield, and an interior part 8, attached to the inner side 3 of the windshield, the parts being located opposite to each other. Both parts exhibit, inwards towards the windshield, a frame-shaped attachment edge 9 and 10, respectively, the surface of which is used for attachment of the parts by gluing against the sides of the windshield.

The above-mentioned division of the vehicle unit into an exterior and an interior part is justified by the fact that windshields with a metal plating (which is becoming increasingly more frequent) shield the microwaves which are used for the radio communication. By dividing the vehicle unit into an exterior part, which lies outside the shielding windshield and provides for the radio communication, and an interior part which is protected and may be reached by the driver, the shielding effect may be avoided when maintaining the operating part of the unit inside the vehicle. The keyboard means according to the invention is, however, not connected to such a divided vehicle unit but may as well be applied to a vehicle unit which comprises one single part, which is located inside the windshield of the vehicle.

At the exterior part 7, the attachment edge 9 constitutes a part of a frame-shaped housing 12, for example of plastics. On its outer side this housing has a frame-shaped opening 13. Into this, a transponder element 14 is inserted. Its main part is the actual transponder circuit, thus an integrated circuit (IC) adapted to receive microwaves carrying information, modulate them and carry response information and to return them to be received by the transmitter-receiver with which the transponder communicates. The transponder element also includes such electronic components as are required for carrying out this communication.

Behind the transponder element 14, on that side of the exterior part 7 which faces the windshield, a signalling element 15 is arranged.

The interior part 8 of the vehicle unit 6 is provided with a housing 18, presumably of plastics, which terminates, inwards towards the side 3 of the windshield, in the above-mentioned frame-shaped attachment surface 10. On the same side there is a signalling element 19, in the mounted position of the two parts, positioned opposite to the signalling element 15 of the exterior part. In addition, the housing 18 comprises ICs for data processing and data storage.

On the outer side of the housing, which side faces inwards towards the cabin of the vehicle, a hinge 22 is arranged in the lower edge thereof. From this hinge, a plate-shaped element 23 is rotatably suspended and adapted to form a control unit intended for actuation by the driver of the vehicle. In the folded-in position shown in FIG. 1, the control element 23 is folded up in alignment with the rear side of the housing 18. In this folded-away position, the element is not accessible for manipulation.

Figure 2:
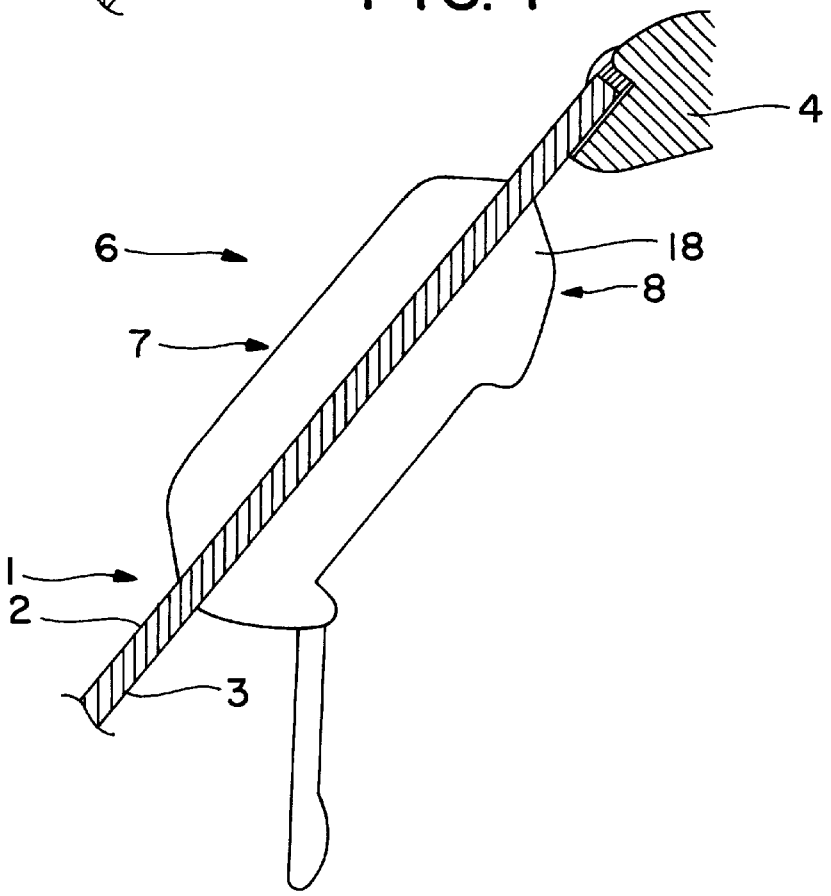
FIG. 2 is a cross section of the windshield corresponding to that shown in FIG. 1, with the two parts of the vehicle unit shown in a side view in a somewhat different functional position from that shown in FIG. 1.

By means of the hinge 22, the element 23 may be folded down to the position shown in FIG. 2. Its edge portion 24 will thus have a free position. Along this edge portion there are keys 25. From FIG. 3 it is clear that there are seven keys in this embodiment and that they are designed as a flexible diaphragm with contact elements, positioned under them, on the side facing away from the windshield. The contact elements may be influenced by pressing down the diaphragm approximately at the centre of the projecting wave-like portions 26, which, indicate the location of the seven keys. Also other embodiments of the keys are possible, such as in the form of push-buttons, and the number, distance, etc., may, of course, be varied within wide limits.

One important principle in the solution chosen is, however, that the row of keys is located next to the free edge of the control element and, in addition, that the pressure points for operation are suitably located on the side facing away from the windshield. The intention is for the keys to be operated in such a way that the edge portion is pinched with the thumb on the side facing away from the windshield and with one or a couple of fingers on the other side, with the thumb and the finger placed straight opposite to the key which is to be pressed down. By a pinching movement, such that the portion 24 is pressed between the thumb and the supporting fingers, the key in question may be pressed down. In this way, the control element will not be subjected to any significant external free forces, the course of forces for the depression extending between the thumb and the fingers via the liner in the form of the edge portion 24. In ordinary keyboard and push-button arrangements, the stand supporting the key constitutes the back pressure for depression and will thus be loaded with an external force, which is desired to be avoided in the embodiment of the vehicle unit according to the invention.

Furthermore, the interior part 8 is provided with a display for displaying characters and/or one or more light indicators. In the embodiment shown, a display 30 is placed on the control element 23 inside the edge portion 24 and on that side which, in the folded-out position in FIG. 2, is directed outwards from the windshield. In this position, the display can thus be observed by the driver. However, it is, of course, also possible to place a display and/or light indicators on other surfaces of the housing 18 of the interior part, for example on the surface 31 thereof, which, in the folded-in position of the control element shown in FIG. 1, is located behind the same.

The control elements with their contact elements and any displays and/or light indicators are connected to the ICs 2 of the interior part. Also some sound indicator may be arranged, in such case is also connected to the IC.

For its function, the vehicle unit is influenced by the roadside transmitter and receiver equipment by means of microwaves, which are received and processed in the transponder element 14 in the exterior part 7 of the unit. In this way, a certain amount of communication between the vehicle unit and the roadside may be carried out, such as identification operations from both sides and certain operations for carrying out the registering operation relating to a toll fee intended to be collected in a road toll unit.

To carry out the necessary data processing and data storage, it is assumed that a certain part of these operations be carried out in the IC 20 in the interior part 8 of the vehicle unit. Furthermore, it is assumed that certain results of the process are to be indicated to the driver by means of the interior part 8 with the aid of its display and any light and/or sound indicators. It is also assumed that the driver in certain respects is to be able to influence the process by pressing the keys.

These functions, distributed between the two parts, require an exchange of data between them. To this end, the two signalling elements 15 and 19 are provided. With the aid of these elements, an internal data transmission between the two parts is to be carried out via the windshield 1.

For operation of the vehicle unit, a certain supply of electrical energy is required. This can be obtained by mounting one or more electric batteries/cells or by the supply of electric current from the vehicle system through a cable.

When there is no need of communication with the driver, the vehicle unit may have the position shown in FIG. 1, thus with the control element 23 folded in. When the vehicle unit is to be used and the driver wants access to the information given by the display and/or light indicators, the control element 23 is folded down to the position shown in FIG. 2. At the same time, the keys 26 are free for operation by pressing the respective key and hence its contact member with the thumb or the finger in the pinching movement described. Under the conditions prevailing, this mode of operation provides very good precision. Pressing down a key on a keyboard while the vehicle is rolling, and while simultaneously controlling the vehicle, may be difficult, in particular if the keyboard is placed as the described vehicle unit, such that the driver must reach his arm upwards; another location for the keys would mean that the vehicle unit could not be designed in the simple and flexible way as suggested in the embodiment. In addition, the desired key can be easily found, with good precision, without having to use one's eyes, which may be of great importance if the vehicle at the same time is to be driven. By holding around the projecting edge portion of the control element, it is easy to find the correct position when a key is to be pressed down. When there are more than four keys, the indication 26 of the shape of the key positions may be designed in special ways to facilitate the orientation, for example by dividing the keys into groups.

An advantageous feature of the invention is the described arrangement of operating keys and a display, which permits the simple, concentrated design of the vehicle unit and which makes its stationary location at the top of the windshield possible. How the pressing of the keys is facilitated by arranging for a pinching movement has been described. Additionally, the advantage is obtained that, if the control part is made capable of being folded out, as described, then the view will be blocked to the least possible extent if the control part is folded in when it is not needed.

The scope of the appended claims, however, does not exclude other ways of designing of the vehicle unit, both with respect to its external design and its internal functional parts. The location close to the upper edge of the windshield, as shown in the embodiment, is generally suitable in private cars. In buses and trucks with higher windshields, a location somewhat below the upper edge may make the control of the unit more comfortable for the driver. The concept stationary implies that the control unit has a fixed location when being used, which, however, is not essentially used for support when pressing the keys. By the pinching movement, both pressure and back pressure may be exercised with the hand. The fact that the unit is stationary, however, does not exclude that it may be movable after being released.

What is claimed:

1. A keyboard means in stationary control units (23) in a vehicle, and in particular those which comprise a transponder for remote communication such as by means of microwaves and which, for executing the remote communication, require a specific location in the vehicle and a limited size, such that an ordinary keyboard is not suitable to arrange, characterized in that the control unit (23) is adapted to be connected to an attachment (18) in the vehicle, to an internal portion thereof, and that it comprises an outer edge portion in the form of a thin plate (23) and that the keys (24) of the means are arranged on this plate (23), which has such a limited thickness that it may be embraced in a pinching movement, preferably between the thumb and some finger, of a hand which, when operating the keyboard means, is inserted over the plate at said outer edge portion so as to enable a key to be pressed down from one side of the plate while supporting the same from the opposite side by a finger, whereby the plate and hence the control unit at its outer edge portion only need to be subjected to very limited free forces during the operation.

Figure 3:
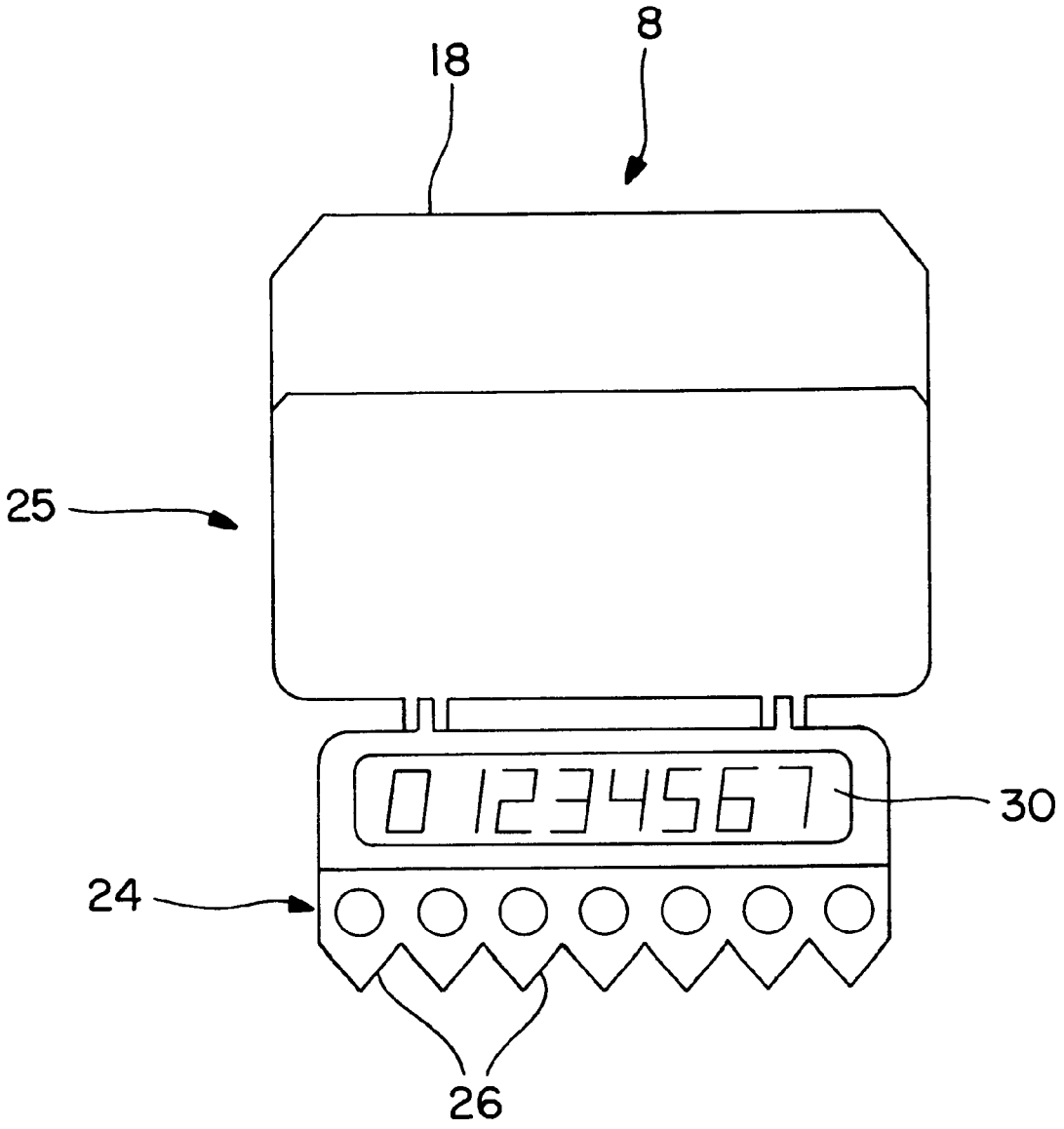
FIG. 3 is a front view of the inner side of the vehicle unit in the functional position shown in FIG. 2 (corresponding to a view from the right-hand side in FIG. 2).

2. A keyboard means according to claim 1, characterized in that the control unit (23) is connected to the attachment (18) by means of a hinge (22) in such a way that the unit may be folded in with the outer edge portion, supporting the plate (23), against the location of the attachment in the vehicle, or, alternatively, be folded out to an operating position (FIGS. 2, 3).

3. A keyboard means according to claim 1, characterized in that the keys (24) are designed as pressure points on a diaphragm, whereby the outer edge portion of the unit (23), also forming the edge of the plate (23), is designed with projections (26) by means of which the positions of the pressure points are marked, such that the positions thereof may be sensed with the fingers.

4. A keyboard means according to claim 1, characterized in that close to the keys (24), which preferably form a row, there is arranged a display (30).

* * * * *